US007091770B2

(12) United States Patent
Schlaffer

(10) Patent No.: US 7,091,770 B2
(45) Date of Patent: Aug. 15, 2006

(54) CIRCUIT ARRANGEMENT FOR VOLTAGE REGULATION

(75) Inventor: Andreas Schlaffer, Munich (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/970,363

(22) Filed: Oct. 21, 2004

(65) Prior Publication Data

US 2005/0073285 A1 Apr. 7, 2005

Related U.S. Application Data

(63) Continuation of application No. PCT/DE03/01135, filed on Apr. 7, 2003.

(30) Foreign Application Priority Data

Apr. 23, 2002 (DE) ..... 102 18 097

(51) Int. Cl.
*G05F 1/10* (2006.01)

(52) U.S. Cl. ..... 327/541; 327/540; 323/316

(58) Field of Classification Search ..... 327/534, 327/535, 537, 538, 540, 541, 543, 545, 546; 363/59, 60; 323/316
See application file for complete search history.

(56) References Cited

U.S. PATENT DOCUMENTS 5,039,877 A * 8/1991 Chern ..... 327/536
5,264,785 A 11/1993 Greason
5,448,199 A * 9/1995 Park ..... 327/546
5,493,207 A 2/1996 Beasom
5,553,295 A * 9/1996 Pantelakis et al. ..... 713/300
5,838,189 A * 11/1998 Jeon ..... 327/537
6,278,316 B1 * 8/2001 Tanzawa et al. ..... 327/536
6,304,094 B1 * 10/2001 Gilliam ..... 324/765
6,496,027 B1 * 12/2002 Sher et al. ..... 324/763
2002/0084830 A1 * 7/2002 Seo et al. ..... 327/536
2002/0145466 A1 * 10/2002 Shimomura ..... 327/540
2004/0027193 A1 * 2/2004 Katoh et al. ..... 327/540

FOREIGN PATENT DOCUMENTS

DE 197 44 686 A1 10/1998
DE 199 47 115 A1 6/2001

* cited by examiner

*Primary Examiner*—Terry D. Cunningham
(74) *Attorney, Agent, or Firm*—Dickstein Shapiro Morin & Oshinsky LLP.

(57) ABSTRACT

Circuit arrangement for voltage regulation having a voltage divider and a regulating circuit. The voltage divider is arranged between a first potential and a reference-ground potential and has a plurality of diodes connected in series, wherein an output voltage is tapped off at a terminal of one of the diodes. The regulating circuit, to which the output voltage and a reference voltage are applied, regulates the first potential based on a comparison of the output voltage with the reference voltage. The divider ratio of the voltage divider is altered by activating or deactivating one or more of the diodes, and is additionally altered by setting a magnitude of a voltage drop across at least one of the diodes.

25 Claims, 1 Drawing Sheet

CIRCUIT ARRANGEMENT FOR VOLTAGE REGULATION

CROSS-REFERENCE TO RELATED APPLICATION

This application is a continuation of International Patent Application Ser. No. PCT/DE03/01135, filed Apr. 7, 2003, which published in German on Nov. 6, 2003 as WO 03/091818, and is incorporated herein by reference in its entirety.

FIELD OF THE INVENTION

The present invention relates to a circuit arrangement for voltage regulation which enables a precise setting of a voltage.

BACKGROUND OF THE INVENTION

The invention relates to a circuit arrangement for voltage regulation having a voltage divider, which is arranged between a first potential and a reference-ground potential and which has a multiplicity of diodes connected in series, wherein it is possible to tap off an output voltage at a terminal of a diode. The circuit arrangement also has a regulating circuit, to which the output voltage and a reference voltage are applied for the purpose of regulating the first potential on the basis of a comparison of the output voltage with the reference voltage, wherein it is possible to alter the divider ratio by activating or deactivating one or more diodes.

Such circuit arrangements for voltage regulation are used for example in integrated circuit arrangements in which a voltage is generated which is greater than the supply voltage of the integrated circuit. Such voltages are required for example in order to erase memory cells of a non-volatile memory, in particular EEPROM memories.

The problem that arises in this case is in regulating the potential difference between the first potential and the reference-earth potential, the potential difference being referred to as high voltage hereinafter. Since the high voltage lies above the supply voltage, it is not possible directly to measure and to regulate this high voltage. For this reason, voltage dividers are used, so that the measurement and regulation can be effected at a lower voltage level lying below the supply voltage.

Two different types of voltage dividers are usually used. If a precise setting possibility is required for the divider ratio, dividers are constructed from resistor chains. Individual resistors can be bridged in order to set the divider ratio. The fineness of the setting possibility results from the magnitude of the respectively bridged resistor in relation to the total resistance of the divider. However, such dividers have the disadvantage that the area requirement is comparatively large and this therefore constitutes an unfavourable solution from cost standpoints.

A more favourable solution with regard to the area requirement consists in constructing the voltage divider from diodes; in particular, dividers comprising MOS transistors each connected as a diode are known. In order to be able to use such a divider, however, it is a prerequisite that the minimum required setting granularity of the divider is greater than the threshold voltage of the transistors. In this case, the voltage is set by activating or deactivating individual diodes. If a realistic value of approximately 0.6 V is assumed for the threshold voltage of the transistors, the high voltage can only be set in steps of 0.6 V.

In order to be able to refine the setting granularity in the previous solution for realizing a voltage divider, the nominal voltage drop across a divider element must be reduced, so that, by means of the activation or deactivation of the divider element, the total voltage can be altered by a voltage drop of 0.2 V, for example. In such a case, however, diodes or MOS transistors can no longer be used since their threshold voltage is reached at 0.6 V and a voltage divider constructed in such a way is no longer functional below that.

SUMMARY OF THE INVENTION

It is an object of the invention, therefore, to specify a circuit arrangement for voltage regulation which enables a precise setting of the voltage and which nevertheless has a small area requirement.

This object is achieved by means of a circuit arrangement of the type mentioned in the introduction which is characterized in that the divider ratio can additionally be altered by setting the magnitude of the voltage drop in the case of at least one of the diodes.

With regard to the voltage divider, the circuit arrangement according to the invention may be constructed completely from MOS transistors, which have a very small area requirement in comparison with resistors. The fineness of the setting of the divider ratio is achieved in that the coarse setting can be performed as before by activating or deactivating individual diodes and, moreover, the fine regulation is realized in that the voltage drop across one or more of the diodes can be set separately. Whereas a voltage drop of typically 0.6 V arises in the case of the diodes without additional circuitry, the parallel-connected transistor provided in accordance with a development of the invention means that this voltage drop can be set arbitrarily between 0 V and 0.6 V.

It is particularly advantageous that the current through the other diodes of the voltage divider is not altered as a result and the voltage drop across these diodes therefore remains the same. Therefore, the high voltage can always be calculated from a nominal voltage drop across the diodes and the voltage set across the at least one diode.

In an advantageous refinement of the invention, a control circuit is used for driving a transistor connected in parallel with a diode, the transistor being able to be driven by the control circuit in such a way that one of the terminals of the diode assumes a predetermined voltage.

BRIEF DESCRIPTION OF THE DRAWINGS

The invention is explained in more detail below using an exemplary embodiment. In the figures.

DETAILED DESCRIPTION OF THE PREFERRED MODE OF THE INVENTION

Figure 1:
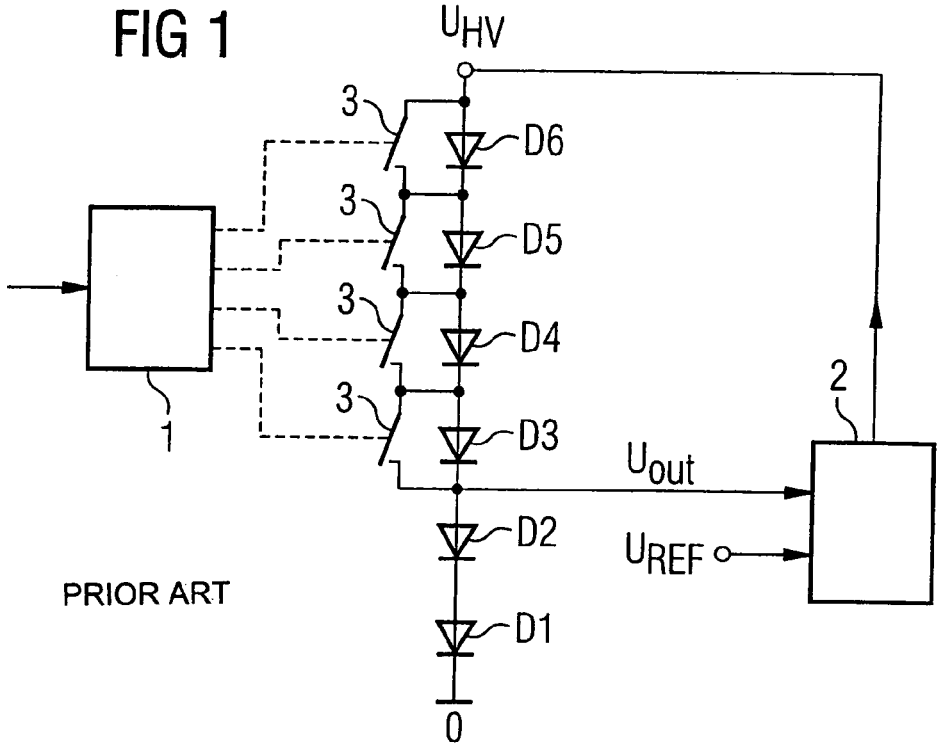
FIG. 1 shows a circuit arrangement for voltage regulation according to the prior art.

In order to facilitate the understanding of the invention, firstly a description will be given, with reference to FIG. 1, of how a circuit arrangement according to the prior art functions and of the causes of the problems which occur there. A voltage divider comprising the diodes D1 to D6 is connected between a high voltage $U_{HV}$ and a reference-earth potential 0. The high voltage $U_{HV}$ is divided uniformly between the diodes D1 to D6, provided that identical diodes are involved. Between the diodes D2 and D3, an output voltage $U_{out}$ is tapped off and fed to a regulating circuit 2. This arrangement forms a voltage divider for which the following holds true: $U_{out}=U_{HV}/3$. In the regulating circuit 2, the measured voltage $U_{out}$ is compared with a reference voltage $U_{REF}$. In this case, $U_{REF}$ is determined in such a way that it is one third of the desired high voltage. The regulating circuit 2 then readjusts the high voltage $U_{HV}$ until the measured voltage $U_{out}$ corresponds to the reference voltage $U_{REF}$.

A different desired value for the high voltage $U_{HV}$ can be set by altering the reference voltage value $U_{REF}$. What is problematic in this case, however, is that a change in $U_{REF}$ is multiplied by the reciprocal of the divider ratio, in other words, in the present case, three times the change in $U_{REF}$ acts on the high voltage $U_{HV}$. This is not problematic in the example shown since the divider ratio is 1:3 and the voltage changes of $U_{REF}$ have to be comparatively large in order to obtain a specific change in $U_{HV}$. In a concrete embodiment of such a circuit, however, a divider comprises significantly more diodes. In the case of a desired high voltage of 16 V and a voltage drop of 0.6 V per diode, it is necessary to provide a divider having 26 diodes connected in series. A change in $U_{REF}$ by 0.1 V thus results in a voltage change of 2.6 V for the high voltage $U_{HF}$. It is evident from this that an exact regulation of the high voltage $U_{HV}$ is difficult.

A second possibility for changing the high voltage $U_{HV}$ consists in changing the divider ratio of the voltage divider. A suitable means for doing this is to bridge individual diodes as a result of which the high voltage $U_{HV}$ is in each case reduced by the magnitude of the voltage drop across a diode, that is to say generally 0.6 V. However, a finer gradation than 0.6 V is not possible in the case of such a circuit. Circuits of this type are nevertheless used in practice. A divider ratio control circuit 1 is provided for bridging one or more diodes D2 to D6 by means of a respective switch 3.

A finer gradation of the setting possibility cannot be obtained with such a circuit constructed with diodes since the threshold voltage of the diodes or transistors used is 0.6 V and cannot be undershot. Although the use of diodes with other semiconductor materials which have a threshold value lower than 0.6 V is conceivable, this is associated with an unjustifiable cost outlay.

Figure 2:
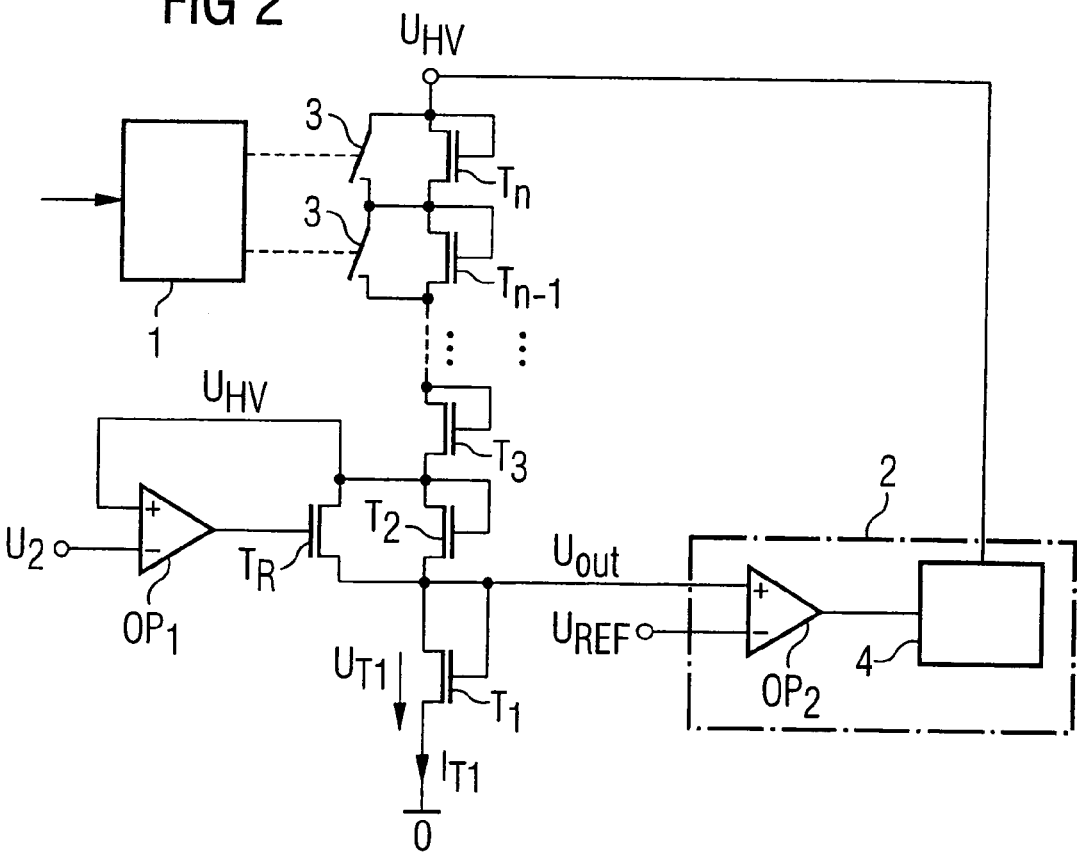
PRIOR ART FIG 2
FIG. 2 shows a circuit arrangement for voltage regulation according to the invention.

A circuit arrangement for voltage regulation according to the invention is illustrated in FIG. 2. Here, too, a voltage divider is constructed by means of diodes, MOS transistors each connected as a diode being involved in the exemplary embodiment shown. These transistors connected as diodes are referred to just as diodes hereinafter. In order that the circuit arrangement illustrated is kept general, the topmost diode is designated generally by $T_n$ and the diodes lying between $T_3$ and $T_{n-1}$ are indicated by dots. The output voltage $U_{out}$ is tapped off above the bottommost diode $T_1$. A regulating circuit 2 regulates the high voltage $U_{HV}$ in such a way that the tapped-off voltage $U_{out}$ again corresponds to a reference voltage $U_{REF}$. In the adjusted state, the voltage $U_{T1}$ across the first diode $T_1$ is equal to the reference voltage $U_{REF}$. A current $I_{T1}$ through the first diode $T_1$ is established in accordance with the diode characteristic curve. Since a series circuit is involved and the input resistance of the regulating circuit 2 tends towards infinity, the currents through all the diodes are identical, as a result of which identical voltage drops are also produced, provided that additional circuitry of the diodes is left out of consideration.

The regulating circuit 2 has an operational amplifier OP2 and also a charge pump circuit 4. The output voltage $U_{out}$ of the voltage divider is applied to the non-inverting input of the operational amplifier OP2. The reference voltage $U_{REF}$ is applied to the inverting input of the operational amplifier OP2. Since the high voltage $U_{HV}$ lies above the supply voltage of the circuit arrangement, the operational amplifier OP2 cannot provide the high voltage $U_{HV}$ directly. Instead, it interacts with a charge pump circuit 4, the high voltage $U_{HV}$ being provided at the output thereof. However, other embodiments are also conceivable for the regulating circuit 2, so that the arrangement shown here is to be understood as only by way of example.

In order to enable a finer setting than the abovementioned steps of 0.6 V, a transistor $T_R$ is connected in parallel with the diode formed by $T_2$. By virtue of the transistor $T_R$, the voltage drop across the diode formed by $T_2$ can be reduced as desired. The consequence of this is that the divider ratio is not only determined from the ratio of the number of diodes across which the output voltage $U_{out}$ is tapped off to the total number of diodes, rather the magnitude of the voltage drop across the parallel circuit comprising $T_2$ and $T_R$ has an influence as an additional analogue setting variable.

A major advantage of such an embodiment is that the sum of the currents through $T_2$ and $T_R$ again corresponds to the current $I_{T1}$, so that the voltage drops across the other transistors connected as diodes are not altered.

In the present exemplary embodiment, the transistor $T_R$ is driven by an operational amplifier OP1, whose non-inverting input is connected to the connection between the transistors $T_2$ and $T_3$. A control voltage $U_2$ is applied to the inverting input of the operational amplifier OP1. In this way, the voltage $U_2$ is impressed at the junction point between the transistors $T_2$ and $T_3$ since the operational amplifier OP1 alters the current through the transistor $T_R$ until the voltage $U_2$ occurs precisely at the junction point between $T_2$ and $T_3$.

In this case, U2 can be set in such a way that $U_{REF}$ is not undershot and $2 \cdot U_{REF}$ is not exceeded. The following holds true in this case:

$$U_{HV}=U_2+(n-2)\cdot U_{REF}.$$

Thus, the regulation bandwidth only lies between 0 V and 0.6 V, which is insufficient, of course, in practice. Therefore, as in the prior art, the possibility of deactivating individual transistors is additionally provided in order thereby to be able to set the high voltage $U_{HV}$ in steps of 0.6 V. To that end, as in the circuit arrangement of FIG. 1, provision is made of a divider ratio controller 1 which drives switches 3 which each bridge a diode.

The fine regulation of the divider ratio is then effected by corresponding driving of the transistor $T_R$ with the voltage $U_2$.

In contrast to a change in the reference voltage $U_{REF}$, in the case of the circuit according to the invention, a change in $U_2$ is not multiplied with the number of diodes of the divider. Therefore, small inadvertent deviations of $U_2$ do not lead to a large error in the high voltage $U_{HV}$.

In the event of an erroneous value of $U_2$ or an error in the regulating circuit formed by OP1 and $T_R$, the maximum expected error in the high voltage is comparatively low, i.e. it is a maximum of 0.6 V, provided that this is the envisaged voltage drop per diode.

The invention claimed is:

1. A circuit arrangement for voltage regulation comprising:

a voltage divider, which is arranged between a first potential and a reference-ground potential and which has a plurality of diodes connected in series, wherein an output voltage is tapped off at a terminal of one of the diodes; and a regulating circuit, to which the output voltage and a reference voltage are applied, and which regulates the first potential based on a comparison of the output voltage with the reference voltage, wherein a divider ratio of the voltage divider is altered by activating or deactivating one or more of the diodes so that a magnitude of a voltage drop across at least one of the diodes is greater than zero and less than the threshold voltage of the at least one of the diodes.

2. The circuit arrangement according to claim 1, wherein the diodes are formed by respective MOS transistors connected as diodes.

3. The circuit arrangement according to claim 1, wherein a second terminal of one of the diodes, whose first terminal is connected to the reference-earth potential, is provided for tapping off the output voltage.

4. The circuit arrangement according to claim 1, further comprising a first transistor connected in parallel with a first one of the diodes to set the voltage drop across this first diode.

5. The circuit arrangement according to claim 4, further comprising a second transistor, which is connected in parallel with a second one of the diodes, which is connected to the first diode, to lower the voltage drop across the second diode.

6. The circuit arrangement according to claim 4, further comprising a control circuit, which drives the first transistor connected in parallel with the first diode, and which has an operational amplifier via which the first transistor is driven such that one of the terminals of the first diode assumes a predetermined voltage.

7. The circuit arrangement according to claim 1, wherein the regulating circuit comprises:

an operational amplifier having a non-inverting input and an inverting input, wherein the output voltage is applied to the non-inverting input and the reference voltage is applied to the inverting input; and a charge pump circuit, which charges an output voltage of the operational amplifier and outputs the first potential.

8. An integrated circuit comprising the circuit arrangement according to claim 1.

9. An integrated circuit comprising the circuit arrangement according to claim 2.

10. An integrated circuit comprising the circuit arrangement according to claim 3.

11. An integrated circuit comprising the circuit arrangement according to claim 4.

12. An integrated circuit comprising the circuit arrangement according to claim 5.

13. An integrated circuit comprising the circuit arrangement according to claim 6.

14. An integrated circuit comprising the circuit arrangement according to claim 7.

15. The circuit arrangement according to claim 4, further comprising a control circuit configured to control the first transistor such that the first transistor sets the magnitude of the voltage drop across the first diode.

16. The circuit arrangement according to claim 15, wherein the control circuit includes an operational amplifier circuit having a feedback loop that is connected to at least one terminal of the first transistor or is connected to at least one terminal of the first diode.

17. The circuit arrangement according to claim 16, wherein the feedback loop is a positive feedback loop.

18. The circuit arrangement according to claim 15, wherein the control circuit includes an operational amplifier circuit having a positive feedback loop, wherein the operational amplifier circuit is connected to at least one terminal of the first transistor and is connected to at least one terminal of the first diode.

19. The circuit arrangement according to claim 15, wherein the magnitude of the voltage drop across the at least one of the diodes is further configurable to be set to at least three different magnitudes, including:

a first magnitude;

a second magnitude that is less than the first magnitude; and a third magnitude that is less than the first magnitude but greater than the second magnitude.

20. An integrated circuit comprising the circuit arrangement according to claim 15.

21. An integrated circuit comprising the circuit arrangement according to claim 16.

22. An integrated circuit comprising the circuit arrangement according to claim 17.

23. An integrated circuit comprising the circuit arrangement according to claim 18.

24. An integrated circuit comprising the circuit arrangement according to claim 19.

25. A circuit arrangement for voltage regulation comprising:

a voltage dividing means, which is arranged between a first potential and a reference-ground potential and which has a plurality of diodes connected in series, wherein an output voltage is tapped off at a terminal of one of the diodes; and a regulating means, to which the output voltage and a reference voltage are applied, and which regulates the first potential based on a comparison of the output voltage with the reference voltage, wherein a divider ratio of the voltage dividing means is altered by activating or deactivating one or more of the diodes so that a magnitude of a voltage drop across at least one of the diodes is greater than zero and less than the threshold voltage of the at least one of the diodes.

* * * * *